United States Patent [19]

Harrison

[11] 4,189,244

[45] Feb. 19, 1980

[54] PLATEN GAP ADJUSTER

[75] Inventor: Gregory F. Harrison, San Jose, Calif.

[73] Assignee: Data Products Corporation, Woodland Hills, Calif.

[21] Appl. No.: 853,346

[22] Filed: Nov. 21, 1977

[51] Int. Cl.[2] ..... B41J 11/20

[52] U.S. Cl. ..... 400/55; 400/59; 400/124; 400/320; 400/618

[58] Field of Search ..... 400/55, 56, 57, 58, 400/59, 60, 124, 618, 320

[56] References Cited

U.S. PATENT DOCUMENTS

| | | | |
|---|---|---|---|
| 2,986,259 | 5/1961 | Salzberger | 400/57 |
| 3,960,256 | 6/1976 | Bickoff et al. | 400/124 |
| 3,987,886 | 10/1976 | Mahoney et al. | 400/55 |
| 4,010,834 | 3/1977 | Linder | 400/124 X |
| 4,024,940 | 5/1977 | Hendrischk et al. | 400/56 |
| 4,063,630 | 12/1977 | Crowe et al. | 400/59 X |
| 4,086,997 | 5/1978 | Wu | 400/57 |

FOREIGN PATENT DOCUMENTS

| | | | |
|---|---|---|---|
| 653587 | 11/1937 | Fed. Rep. of Germany | 400/55 |
| 2556159 | 6/1976 | Fed. Rep. of Germany | 400/56 |

*Primary Examiner*—Ernest T. Wright, Jr.

[57] ABSTRACT

A platen gap adjuster for a printer utilizes a shaft along which the print head carriage slides during printing of each line. The shaft is eccentrically mounted by means of unitary, offset spindles the common axis of which is parallel to but spaced from the shaft axis. By rotating the shaft about the common spindle axis, the carriage and print head will be moved transversely of the shaft, thereby adjusting the gap between the print head and platen without impairing the longitudinal sliding motion of the carriage.

3 Claims, 3 Drawing Figures

PLATEN GAP ADJUSTER

BACKGROUND OF THE INVENTION

1. Field of the Invention

The present invention relates to a mechanism for adjusting the transverse position of a member slidable along a shaft, the mechanism being particularly useful as a platen gap adjuster in a printer.

2. Description of the Prior Art

Electro-mechanical printers are widely employed as computer output devices or components of typewriter or word processing systems. One type of printer employs a print head which moves across the page to print each line one character at a time. Typically, the head can print any desired character at each print position. At the end of each line, the page is advanced and the print head again is moved across the page to print the next line.

Generally, impact printing is employed. To this end, the print head may employ a set of type fonts for each character, or a set of individual impact styli arranged in a matrix and selectively actuated to print any desired character. A typewriter-like ribbon, carbon paper or other inked media is interposed between the print head and the page. A platen is situated behind the page. Printing is accomplished as the head-mounted type font or styli impacts the ribbon against the page and platen.

Adjustability of the spacing or gap between the print head and the platen is desirable for several reasons. Such gap adjustment accommodates the use of different page thicknesses or number of copies. Thus, a greater spacing may be desirable when printing several "carbons" than when printing a single sheet. Further, the effective impact force can be controlled by adjusting the platen gap. A smaller gap will result in a stronger impact, which may be desirable for "darker" printing, or undesirable if e.g., it causes tearing or punching of holes through the ribbon. An object of the present invention is to provide an improved platen gap adjuster.

The difficulty in facilitating platen gap adjustment arises from the fact that the print head and its associated carriage must be free to move across the page. The platen gap adjustment direction is transverse to this movement, and must be made without interfering with that movement. One approach is to adjust the position of the print head with respect to the carriage itself. While such adjustment does not interfere with the movement of the carriage across the page, such adjustments are critical, have required the use of tools, and necessitate opening of the printer housing and the use of tools within such housing. Such arrangements are unsatisfactory, as they do not permit gap adjustment e.g., to compensate for different numbers of copies, by unskilled personnel.

A further object of the present invention is to provide a mechanism for accomplishing platen gap adjustment without the use of tools and without altering the mounted position of the print head on its carriage. The adjustment facilitates changing of the platen gap by as little as a few thousandths of an inch, repeatably and accurately, and without interfering with the movement of the carriage across the page. The adjustment can be made by an unskilled operator. The same adjustment also enables withdrawal of the print head away from the platen, and concomitant disengagement of the paper tensioning fingers, so as to facilitate paper insertion and removal.

SUMMARY OF THE INVENTION

These and other objectives are achieved by the inventive mechanism which employs a shaft that is mounted by integral, offset spindles at each end. The print head carriage is bearing-mounted to the shaft and slides along the shaft during the printing of each line. The axis of the shaft is offset from, but parallel to the common axis of the spindles. By rotating the shaft slightly about the spindle axis, a transverse motion is imparted to the print head carriage that concomitantly adjusts the platen gap.

Advantageously, a lever arm is attached to one of the spindles. This lever arm is biased against a cam formed on a knob. As the knob is rotated through a fixed number of degrees, the lever will rotate the shaft through a fixed angle, thereby changing the platen gap by a set amount. The cam action knob may be provided with detents corresponding to fixed gap adjustment values.

Movement of the lever arm away from the cam action knob will space the print head away from the platen, and will simultaneously withdraw the paper retaining fingers away from the page. This facilitates easy insertion and removal of the sheets being printed.

BRIEF DESCRIPTION OF THE DRAWING

A detailed description of the invention will be made with reference to the accompanying drawing wherein like numerals designate corresponding components in the several figures.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention since the scope of the invention best is defined by the appended claims.

Figure 1:
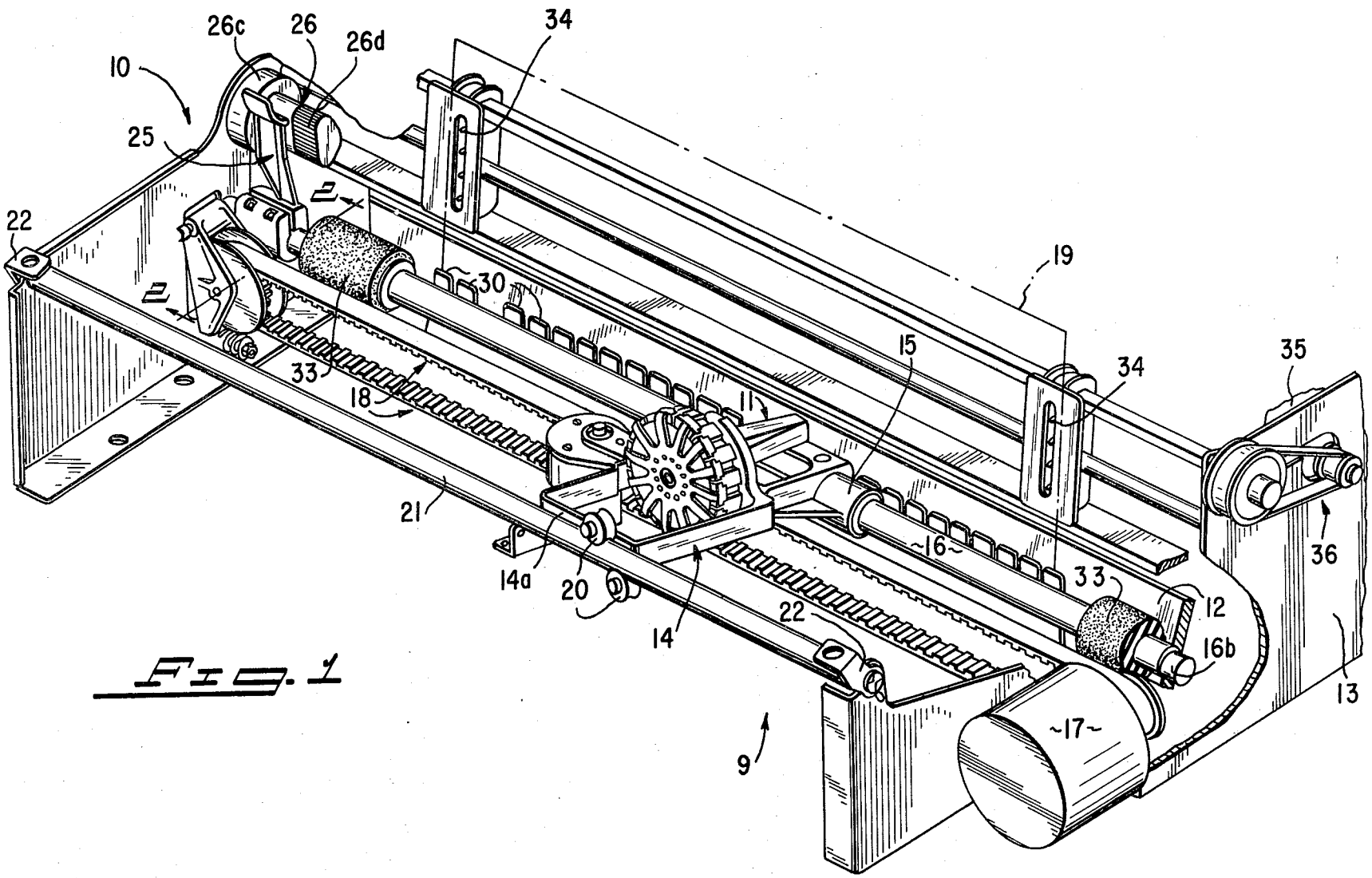
FIG. 1 is a perspective view, partly cut away and in section, of a printer employing the inventive platen gap adjuster.

Referring to FIG. 1, there is shown a printer 9 employing the inventive mechanism 10 for adjusting the gap between a print head 11 and a platen 12. The platen 12 is fixedly mounted to a frame 13 which also supports the other printer 9 components.

The print head 11 is mounted on a carriage 14 which includes a cylindrical bearing 15 that surrounds a circular shaft 16. The carriage 14 is driven along the shaft 16 by a motor 17 and belt 18 so as to transport the print head 11 across the page 19 being printed. Although the invention is not so limited, the print head 11 may comprise a dot matrix print head of the type disclosed in the co-pending U.S. application, of Peter Wolfe et. al Ser. No. 805,706 filed June 13, 1977, which is assigned to the same assignee as the present invention. The rear **14*a* of the carriage 14 is supported by rollers 20 that engage a bar 21 which is non-rigidly mounted to the frame 13**.

Figure 3:
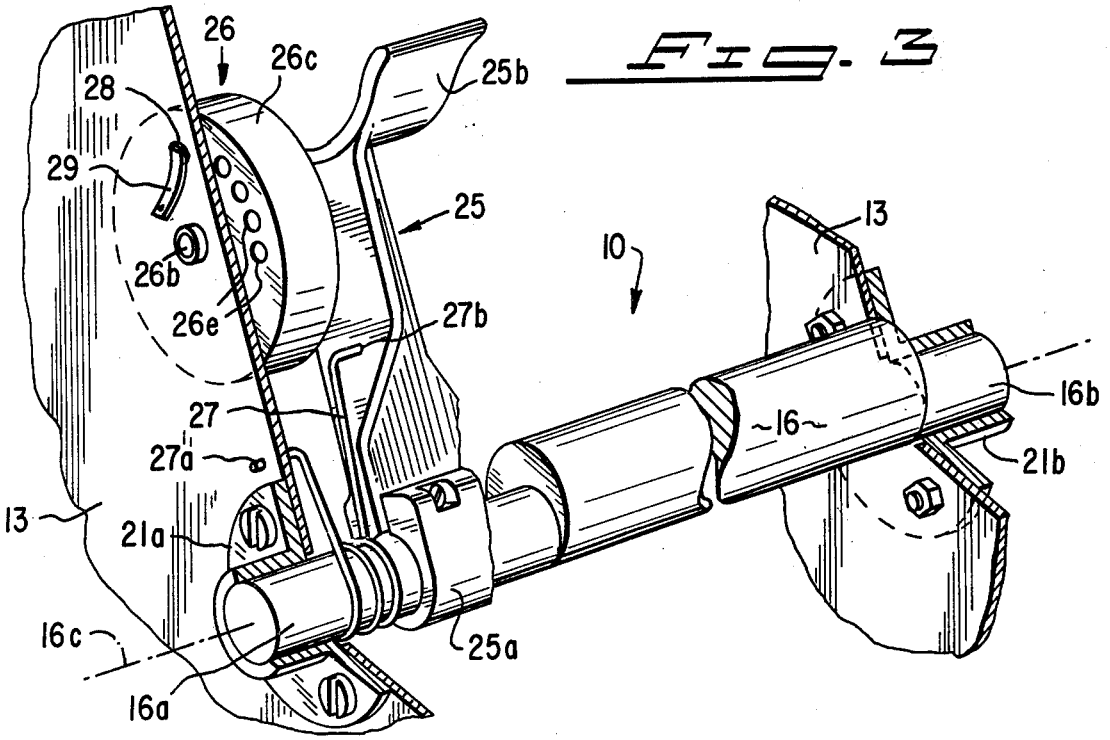
FIG. 3 is a simplified perspective view of the inventive mechanism showing the shaft with its integral, offset spindles, the lever arm and the detent-positioned cam action knob.

As best evident in FIGS. 1 and 3, the shaft 16 includes an integral, offset cylindrical spindle 16*a*, 16*b* at each end. The spindles 16*a*, 16*b* are coaxial and have a common axis 16*c* which is parallel to, but spaced from the axis of the shaft 16. The spindles 16*a*, 16*b* are journal-mounted to the frame 13 by means of bearings 21*a*, 21*b*.

The shaft 16 with its offset spindles 16*a*, 16*b* is the principal component of the inventive platen gap adjuster. By rotating the shaft 16 through a small angular amount about the spindle axis 16*c*, the offset axis of the shaft 16 will be displaced slightly in a lateral direction. Since the shaft 16 engages the bearing 15, such shaft 16 rotation will cause the carriage 14 and its print head 11 to be moved slightly toward or away from the platen 12. Such transverse movement in no way hinders the freedom of the carriage 11 to slide along the shaft 16. At the rear of the carriage 14, the slight transverse motion is accommodated by a commensurate slight movement of the bar 21, the ends of which advantageously are pivotally mounted to the frame 13 by means of short pivot arms 22.

It will be appreciated that precise adjustment of the platen gap is accomplished by rotating the shaft 16 through fixed angles. This is accomplished by the cooperation of a lever arm 25 and a cam action knob 26 best shown in FIGS. 1 and 3. One end 25*a* of the lever arm 25 is clamped to the spindle 16*a*. A thumb rest 25*b* is formed at the other end. A flat portion 25*c* (FIG. 2) of the lever arm 25 is biased into contact with a cam 26*a* on the knob 26 by means of a spring 27. Advantageously, the spring 27 is loosely coiled around the spindle 16*a* and has one end 27*a* affixed to the frame 13 and the other end 27*b* affixed to the lever arm 25.

The cam action knob 26 is mounted to the frame 13 by a shaft 26*b*. The circular base 26*c* of the knob 26 includes a set of angularly spaced detent holes 26*e* each at an equal radial distance from the shaft 26*b*. A rigid ball 28, situated in an opening through the frame 13, is caught between a leaf spring 29 on the outside of the frame 13 and one of the detent holes 26*e*. This arrangement maintains the cam action knob 26 in a fixed angular position, but allows rotation of that knob 26 through fixed angles corresponding to the distance between the detent holes 26*e*.

The cam 26*a* is of eccentric, somewhat oval shape. It is an integral part of the knob 26, and terminates in a knurled section 26*d* (FIG. 1) which serves as a finger grip for rotating the knob 26.

Figure 2:
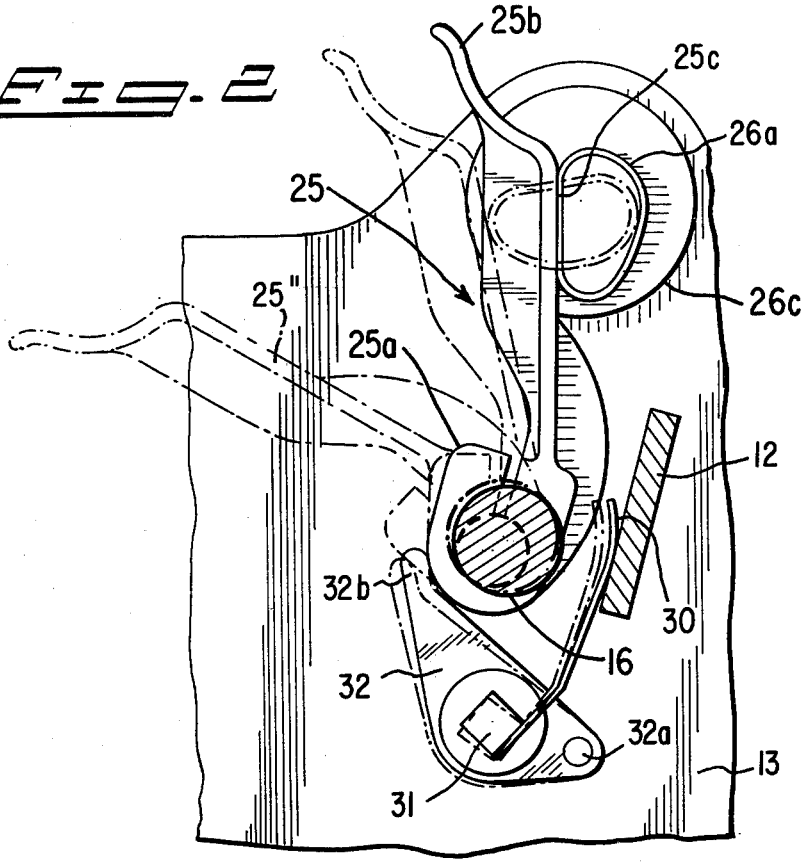
FIG. 2 is a side view of the lever arm and cam action knob components of the invention, as seen generally along the line 2—2 of FIG. 1.

Platen gap adjustment is accomplished by rotating the cam action knob 26 to a selected orientation between the extreme positions shown in solid and in phantom in FIG. 2. In the position shown in solid, the shaft 16 is oriented so that the print head 11 is closest to the platen 12. As the knob 26 is rotated clockwise (as viewed in FIG. 2), the axis of the shaft 16 exhibits a horizontal component of motion to the left, thereby moving the print head 11 away from the platen 12 so as to increase the platen gap. Precise gap adjustment is achieved.

To aid the loading of paper 19 into the printer 9, the lever arm 25 may be rotated away from the knob 26, as to the position shown at 25″ in FIG. 2. This moves the print head 11 sufficiently far away from the platen 12 so as to permit insertion of the page 19. At the same time, rotation of the lever arm 25 also moves a set of leaf spring fingers away from the platen 12. These fingers 30 are used to urge the paper 19 against the platen 12 during printing.

As shown in FIG. 2, the fingers 30 are attached at their bottom end to a bar 31 which itself is mounted to an interconnection member 32. The member 32 is pivotally mounted at one end 32*a* so that its other end 32*b* rides against the clamp portion 25*a* of the lever arm 25. With this arrangement, when the lever arm 25 is moved to the extreme position 25″, the fingers 30 will be spaced from the platen 12 so as to permit easy loading of the paper 19.

Cylindrical bumpers 33 (FIG. 1) may be provided on the shaft 16 to aid in holding the page 19 against the platen 12 during printing. A pair of sprocket chains 34 are provided to advance the page 19 after each line has been printed. The chains 34 are driven by a motor 35 via a belt and pulley arrangement 36.

Intending to claim all novel features shown or described, the inventor claims:

1. In a printer of the type having a print head which traverses across a page to be printed, wherein said printer has a stationary frame, the improvement for adjusting the gap between said print head and a platen behind said page, comprising:

a shaft having a circular cross-section and extending across said page in spaced parallel relation to said platen, said print head being bearing mounted to said shaft so as to be slideable along said shaft across said page;

said shaft having integral offset spindles, said spindles having a common axis that is offset from but parallel to the axis of said shaft, said spindles being journal mounted to said frame so that slight rotation of said spindles about said common axis will cause eccentric rotation of said shaft so as to impart slight transverse displacement to said bearing mounted print head, whereby the spacing between said print head and said platen is adjusted without impairing the slideability of said print head along said shaft; and means for imparting rotation to said spindles and shaft comprising a lever arm attached to said shaft and extending laterally therefrom, and a cam action knob rotationally mounted to said frame, said knob having a cam integral therewith, said lever arm being ordinarily biased against said cam so that rotation of said knob will impart slight rotation to said shaft via said cam and said lever arm, said lever arm being moveable away from contact with said cam so as to impart a relatively large amount of rotation to said shaft, thereby imparting maximum transverse displacement of said print head away from said platen to facilitate insertion and removal of paper from said printer.

2. In a printer of the type having a print head which traverses across a page to be printed, wherein said printer has a stationary frame, the improvement for adjusting the gap between said print head and a platen behind said page, comprising:

a shaft having a circular cross-section and extending across said page in spaced parallel relation to said platen, said print head being bearing mounted to said shaft so as to be slideable along said shaft across said page;

said shaft having integral offset spindles, said spindles having a common axis that is offset from but parallel to the axis of said shaft, said spindles being journal mounted to said frame so that slight rotation of said spindles about said common axis will cause eccentric rotation of said shaft so as to impart slight transverse displacement to said bearing mounted print head, whereby the spacing between said print head and said platen is adjusted without impairing the slideability of said print head along said shaft; and means for imparting rotation to said spindles and shaft comprising an elongated lever arm attached to one of said spindles and extending laterally therefrom, a cam action knob rotationally mounted to one side of said stationary frame, said knob including detent means cooperating with said frame for maintaining said knob in a selected one of plural angularly separated positions with respect to said frame, said knob having a cam integral therewith, said lever arm normally being biased against said cam by a bias spring connected between said frame and said lever arm so that rotation of said knob will impart slight rotation to said shaft via said cam and said lever arm, said lever arm being moveable away from contact with said cam so as to impart a relatively large amount of rotation to said shaft, thereby imparting a maximum amount of transverse displacement to said print head away from said platen to facilitate insertion and removal of paper from said printer.

3. In a printer of the type having a print head which traverses across a page to be printed, wherein said printer has a stationary frame, the improvement for adjusting the gap between said print head and a platen behind said page, comprising:

a shaft having a circular cross-section and extending across said page in spaced parallel relation to said platen, said print head being bearing mounted to said shaft so as to be slideable along said shaft across said page;

said shaft having integral offset spindles, said spindles having a common axis that is offset from but parallel to the axis of said shaft, said spindles being journal mounted to said frame so that slight rotation of said spindles about said common axis will cause eccentric rotation of said shaft so as to impart slight transverse displacement to said bearing mounted print head, whereby the spacing between said print head and said platen is adjusted without impairing the slideability of said print head along said shaft;

means for imparting rotation to said spindles and shaft comprising a lever arm attached to said shaft and extending laterally therefrom, and a cam action knob rotationally mounted to said frame, said knob having a cam integral therewith, said lever arm being biased against said cam so that rotation of said knob will impart rotation to said shaft via said cam and said lever arm; and a set of leaf spring fingers situated between said shaft and said platen for holding said page against said platen, said fingers being attached to a bar mounted in spaced parallel relation to a common axis of said spindles, and an interconnection member between said bar and said lever arm, movement of said lever arm away from said cam substantially increasing the gap between said print head and said platen and imparting via said interconnection member movement to said bar so as to move said fingers away from said platen, thereby releasing the pressure exerted by said fingers on said page.

* * * * *